US005379814A

United States Patent [19]

Posly

[11] Patent Number: 5,379,814

[45] Date of Patent: Jan. 10, 1995

[54] WATER BOTTLE LIFTING MECHANISM

[76] Inventor: Louis M. Posly, 243 Lidy Rd., Dupont, Pa. 18641

[21] Appl. No.: 135,805

[22] Filed: Oct. 7, 1993

[51] Int. Cl.[6] ..... B65B 1/04; B65B 3/00

[52] U.S. Cl. ..... 141/351; 141/98; 141/391; 414/420; 414/422; 414/621

[58] Field of Search ..... 141/231, 284, 348, 351, 141/352, 374, 375, 391, 98; 414/420, 422, 621

[56] References Cited

U.S. PATENT DOCUMENTS

| | | | |
|---|---|---|---|
| 1,538,483 | 5/1925 | Grantham | 141/352 |
| 1,946,314 | 2/1934 | Desmond | 141/356 |
| 2,019,034 | 10/1935 | Alex | 62/141 |
| 2,319,739 | 5/1943 | Kessler | 158/40 |
| 3,868,033 | 2/1975 | LeDuff | 414/420 |
| 4,036,382 | 7/1977 | Perry et al. | 414/422 |
| 4,797,050 | 1/1989 | Habicht | 414/420 |
| 5,228,200 | 2/1994 | Burgers et al. | 414/422 |

*Primary Examiner*—Henry J. Recla
*Assistant Examiner*—Steven O. Douglas
*Attorney, Agent, or Firm*—Kane, Dalsimer, Sullivan, Kurucz, Levy, Eisele & Richard

[57] ABSTRACT

A lift mechanism lifts a bottle of water from a lower upright position to an elevated position at which it can be lowered into a well of a water cooler. The lift mechanism includes a bottle elevator and cam operated bottle turning assembly. A closure on the bottle is adapted to be activated by surfaces of the cooler well to move a plunger from a closed position to a position at which water is adapted to flow out of the bottle.

18 Claims, 20 Drawing Sheets

FIG. 11
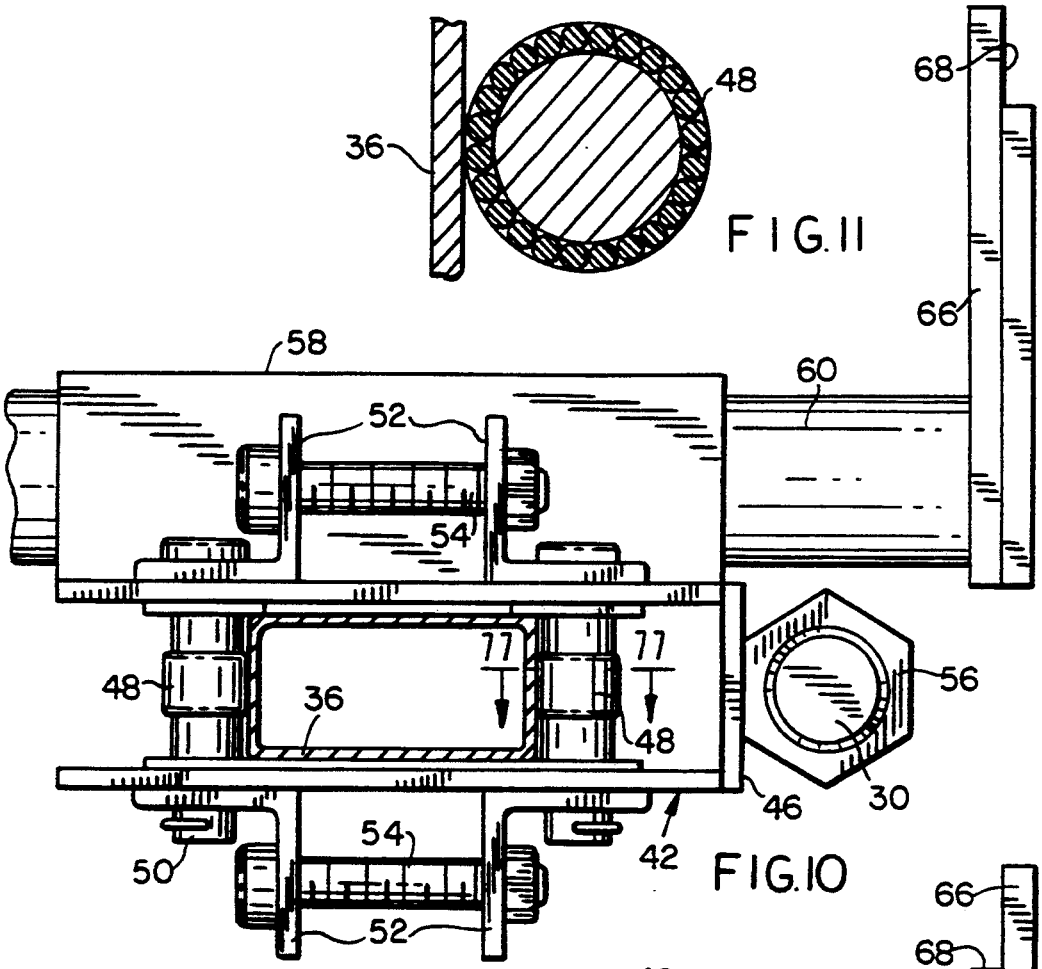
FIG. 10
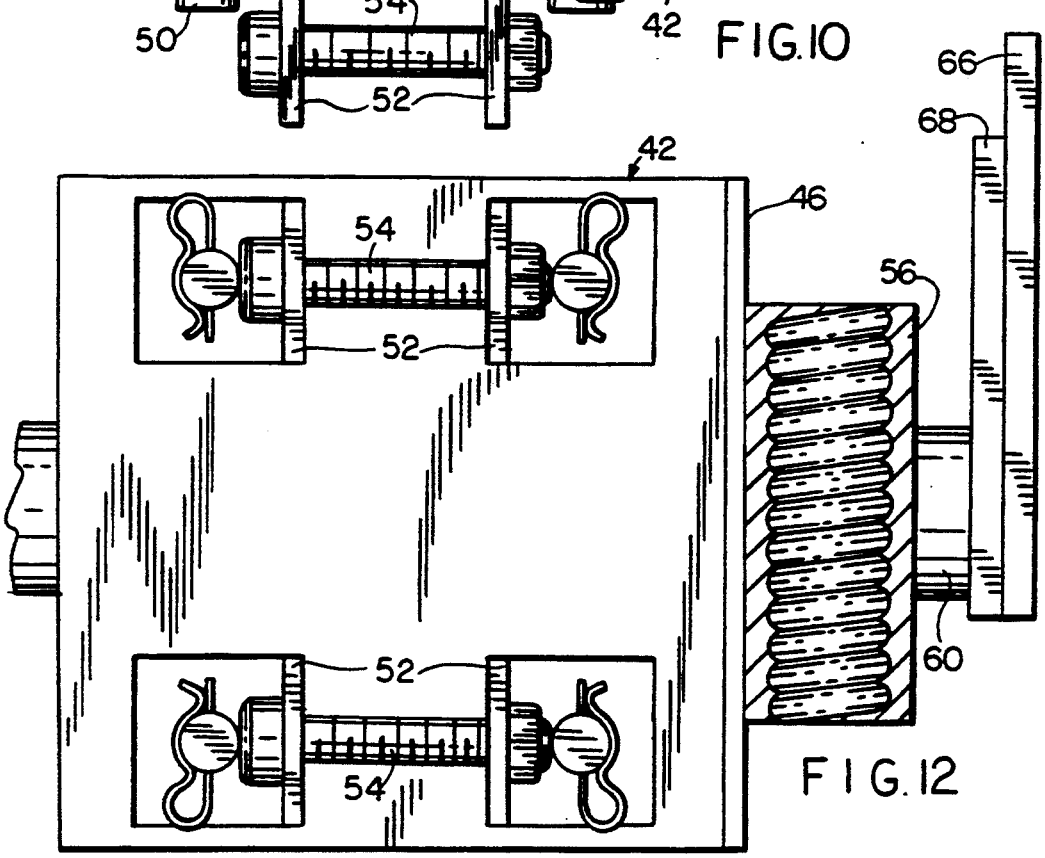
FIG. 12

WATER BOTTLE LIFTING MECHANISM

BACKGROUND OF THE INVENTION

Many offices and establishments offer bottled water to their employees and patrons. Water bottles are normally associated with a water cooler for dispensing and are initially sealed with a cap which is removed in order that the bottle may be lifted and inverted to be placed neck down into the receiving well of the cooler. These bottles whether of plastic or glass when full of water, are heavy so that the typical female and some males simply cannot perform the task of lifting and inverting the water bottle and then lower it into the well of the cooler.

SUMMARY OF THE INVENTION

It is a principal object of the present invention to provide a mechanism for lifting, inverting and lowering a water bottle into the well of a cooler.

Another object is to provide a lift mechanism of the forgoing type which is readily movable and portable so that it may be stored in a convenient "out-of-the way" location, then moved to another location at which a full water bottle is to be placed on the cooler and thereafter be moved back to its stored location.

A further object is to provide a closure for the water bottle which will maintain the bottle opening closed and sealed during bottle lifting, inverting and lowering and when placed on the well of the cooler, cooperate with surfaces of the cooler to open to permit the water in the bottle to be accessed for dispensing from the cooler.

Other objects and advantages will become apparent from the following detailed description which is to be taken in conjunction with the accompanying drawings.

BRIEF DESCRIPTION OF THE DRAWINGS

FIG. 10 is an enlarged top plan view of the elevator assembly with the elevator rail sectional view along the line 10—10 of FIG. 9;

FIG. 11 is a cross-sectioned view taken along the line 11 of FIG. 10 showing a roller bushing of the elevator assembly coupled with the elevator rail;

FIG. 12 is a side elevational view of the elevator assembly of FIG. 10 with the mid sectioned and the threaded rod removed;

DETAILED DESCRIPTION OF THE PREFERRED EMBODIMENTS

Figure 1:
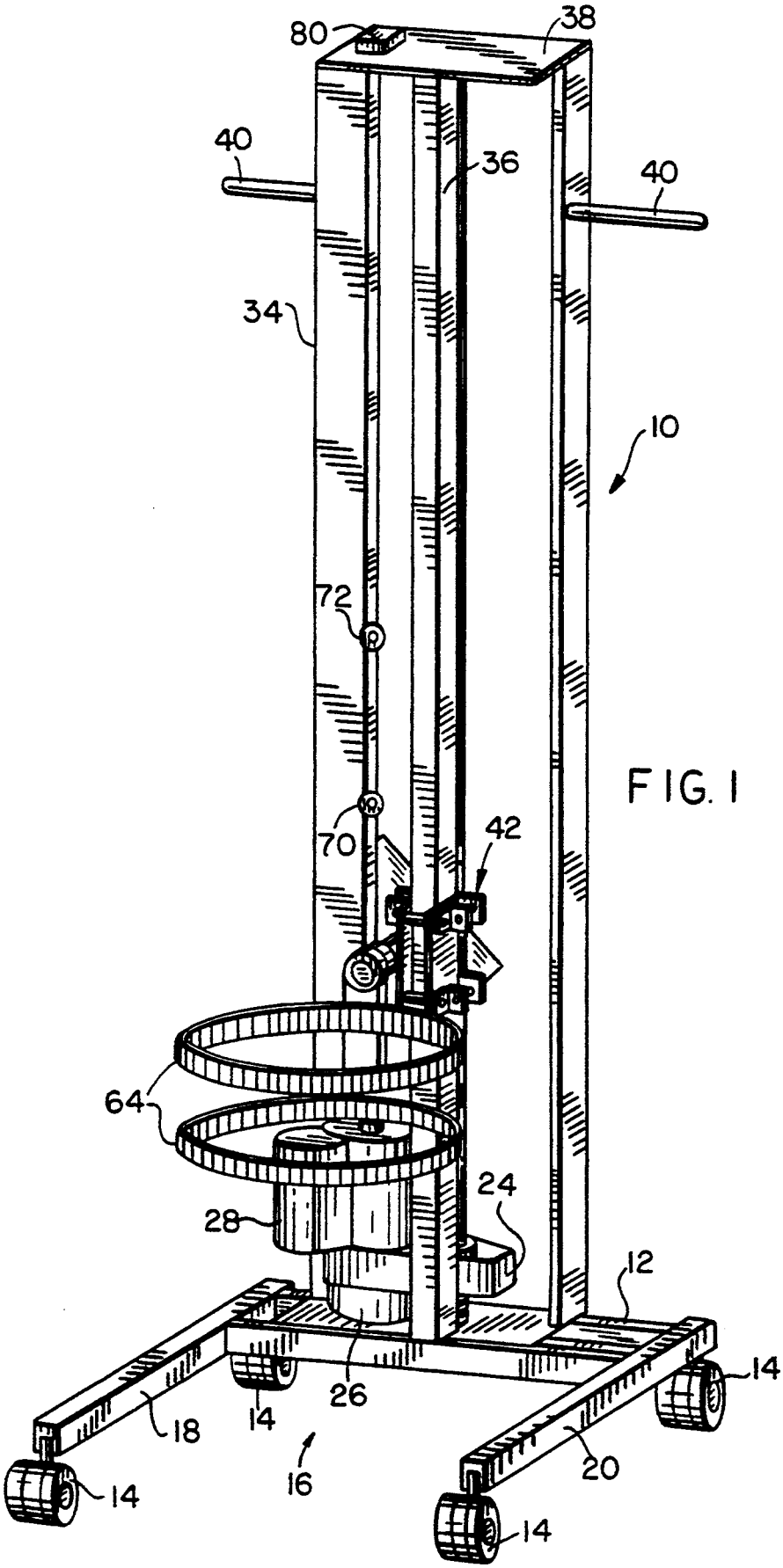
FIG. 1 is a perspective view of the water bottle lifting mechanism of this invention.
Figure 2:
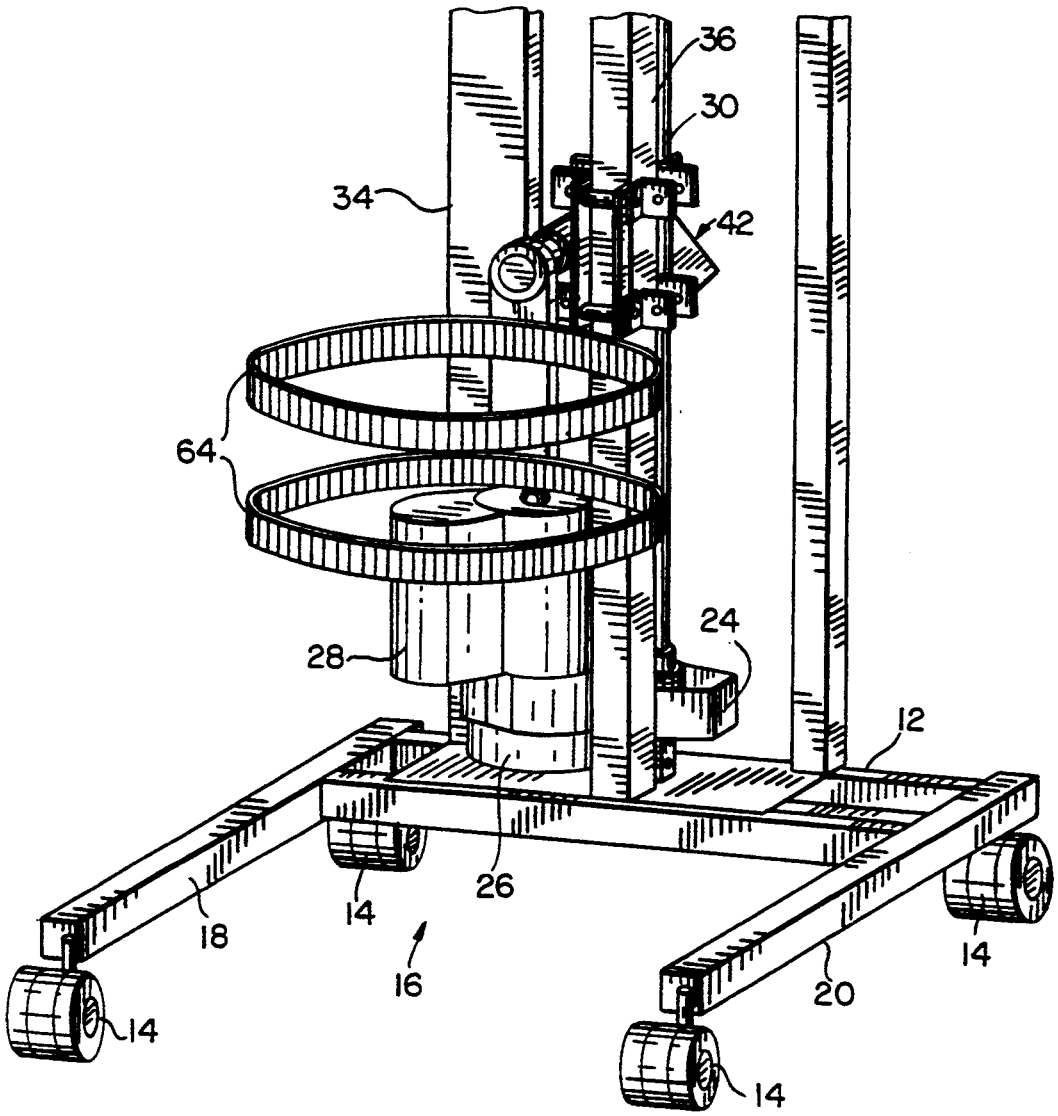
FIG. 2 is an enlarged perspective view of the lower part of the water bottle lifting mechanism of FIG. 1.
Figure 3:
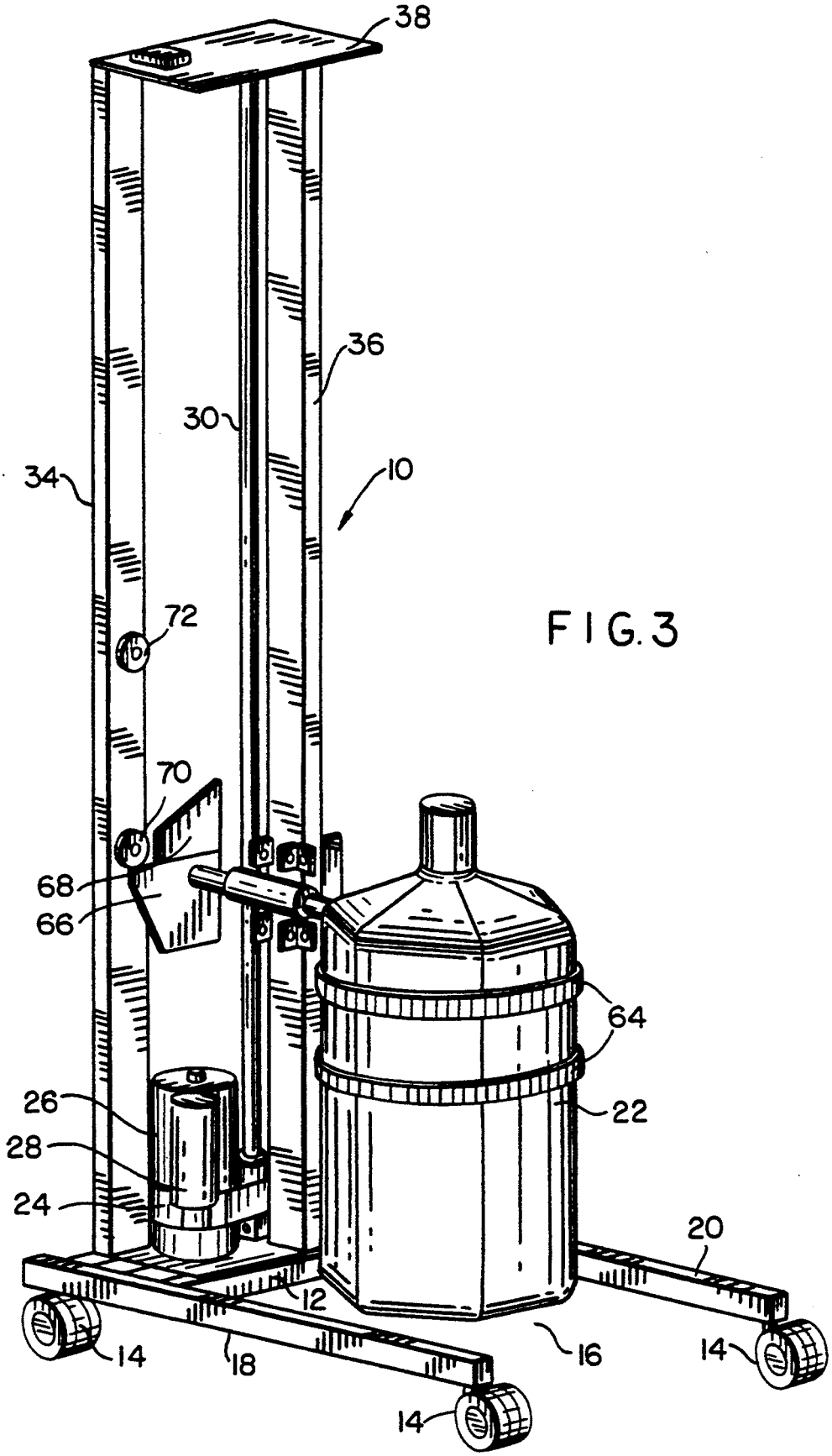
FIG. 3 is a perspective view of the lifting mechanism coupled with a water bottle in its lowermost upright position resting on the floor.
Figure 4:
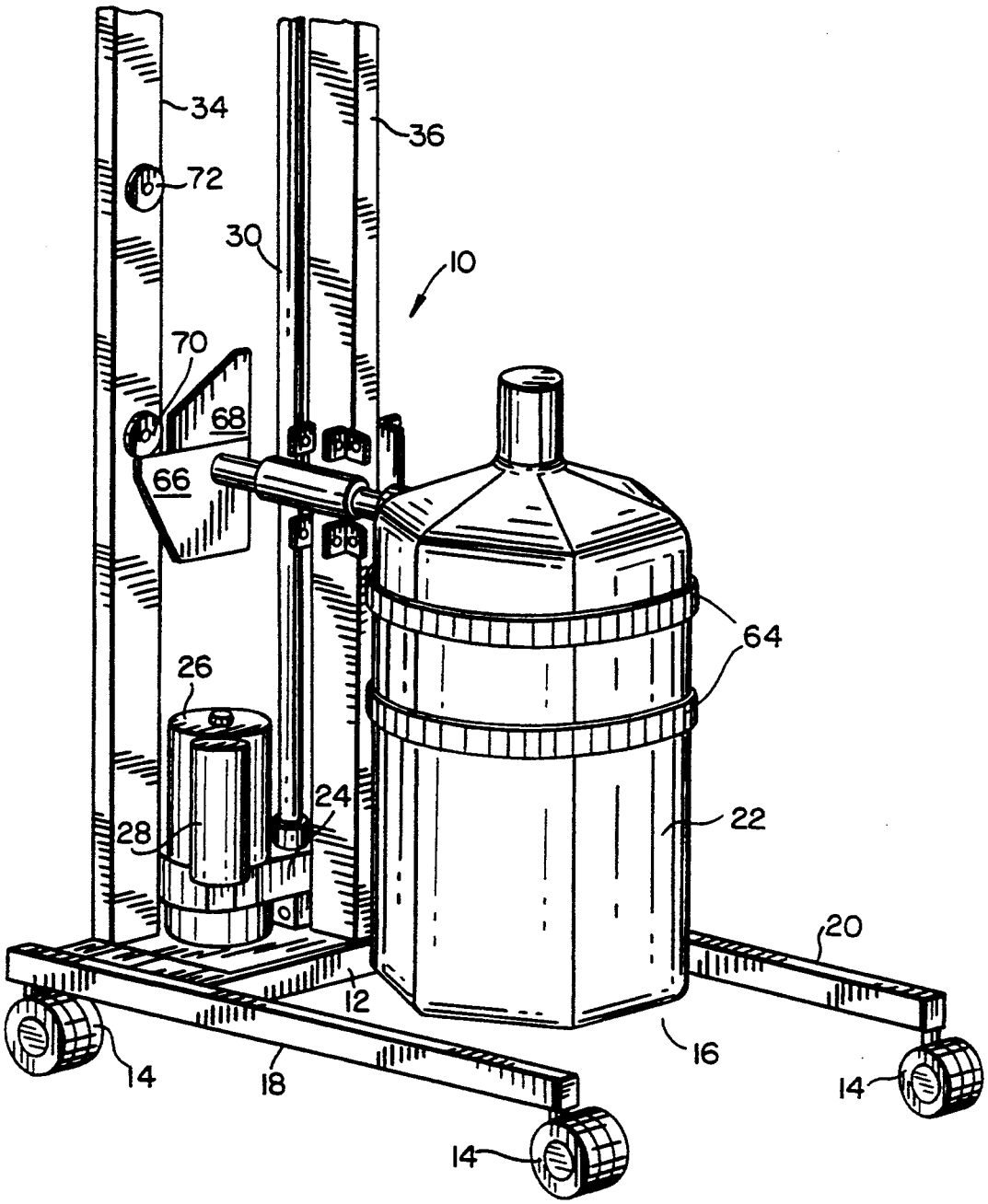
FIG. 4 is an enlarged perspective of the lower part of the lifting mechanism of FIG. 3.
Figures 5, 6:
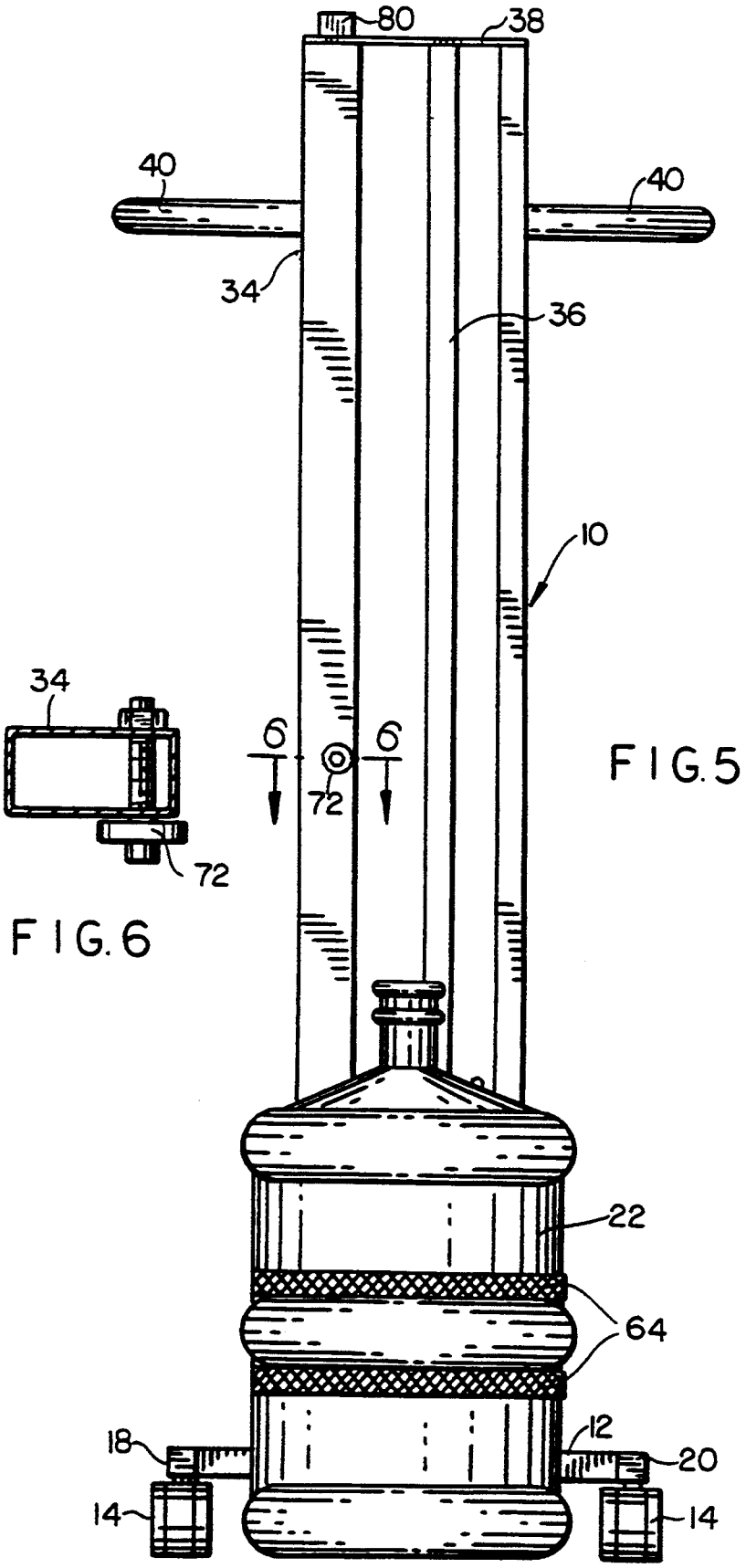
FIG. 5 is a front elevational view of the lifting mechanism with the coupled water bottle resting on the floor and the closure removed for clarity.
FIG. 6 is a cross-sectional view taken along the line 6—6 of FIG. 5 showing the cam bearing.
Figure 7:
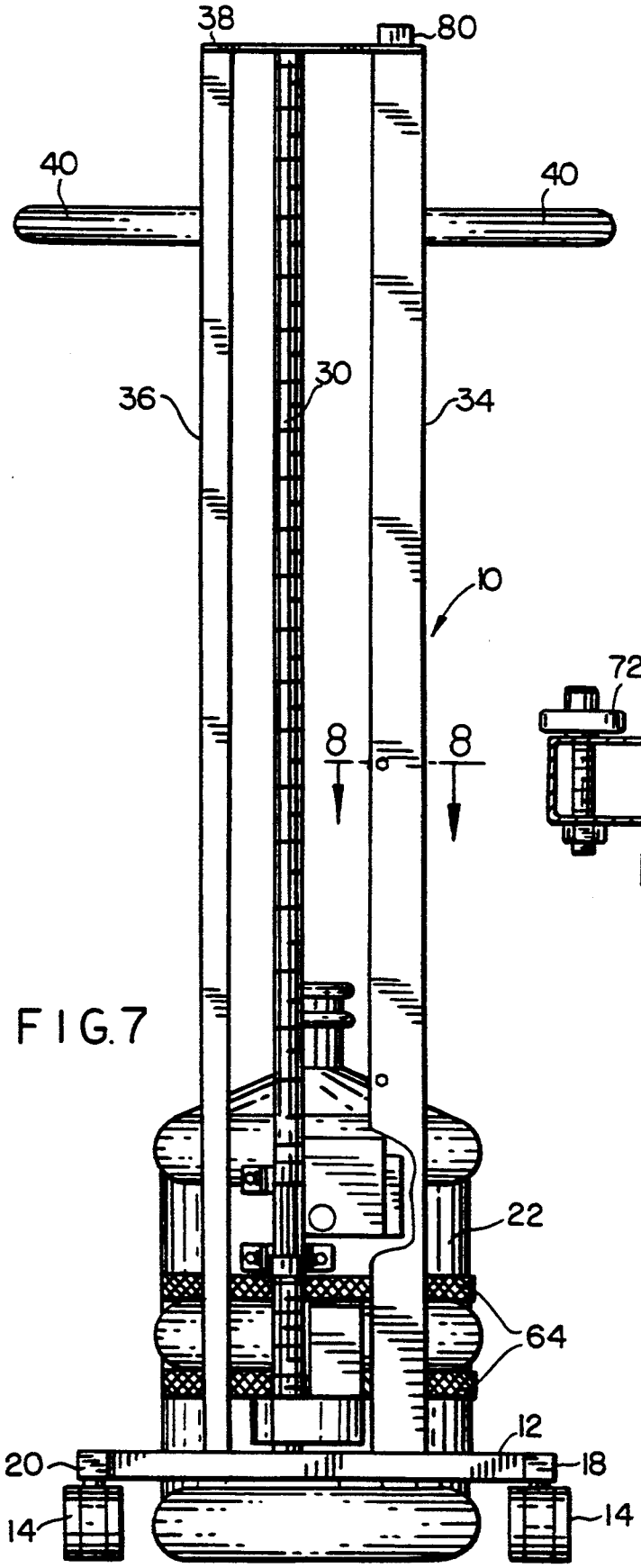
FIG. 7 is a rear elevational view of the lifting mechanism of FIG. 5.
Figure 8:
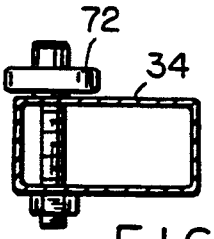
FIG. 8 is a cross-sectional view taken along the line 8—8 of FIG. 7 showing the cam bearing.
Figure 9:
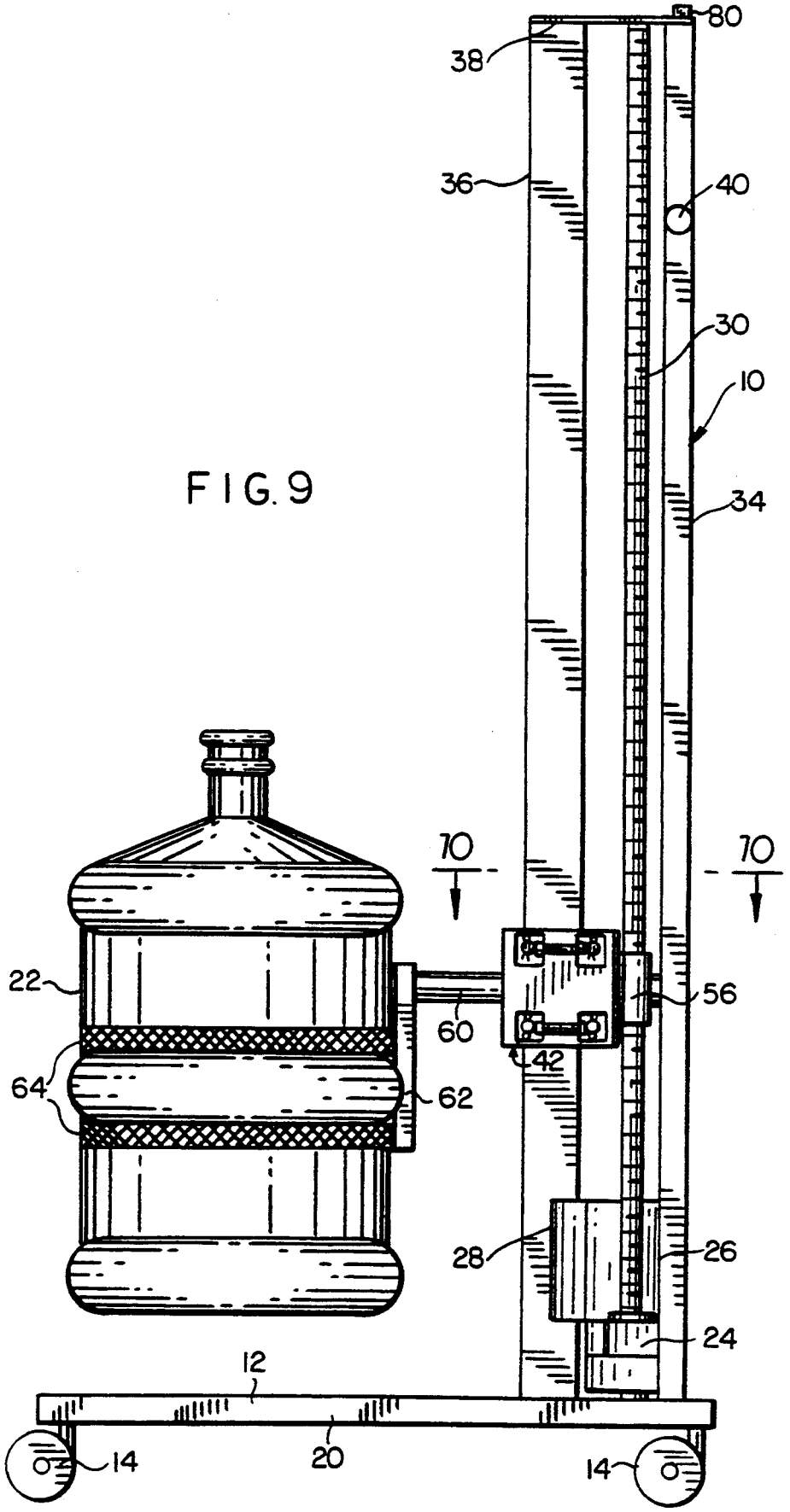
FIG. 9 is a side elevational view of the lifting mechanism with the coupled water bottle being raised vertically a short distance.
Figure 13:
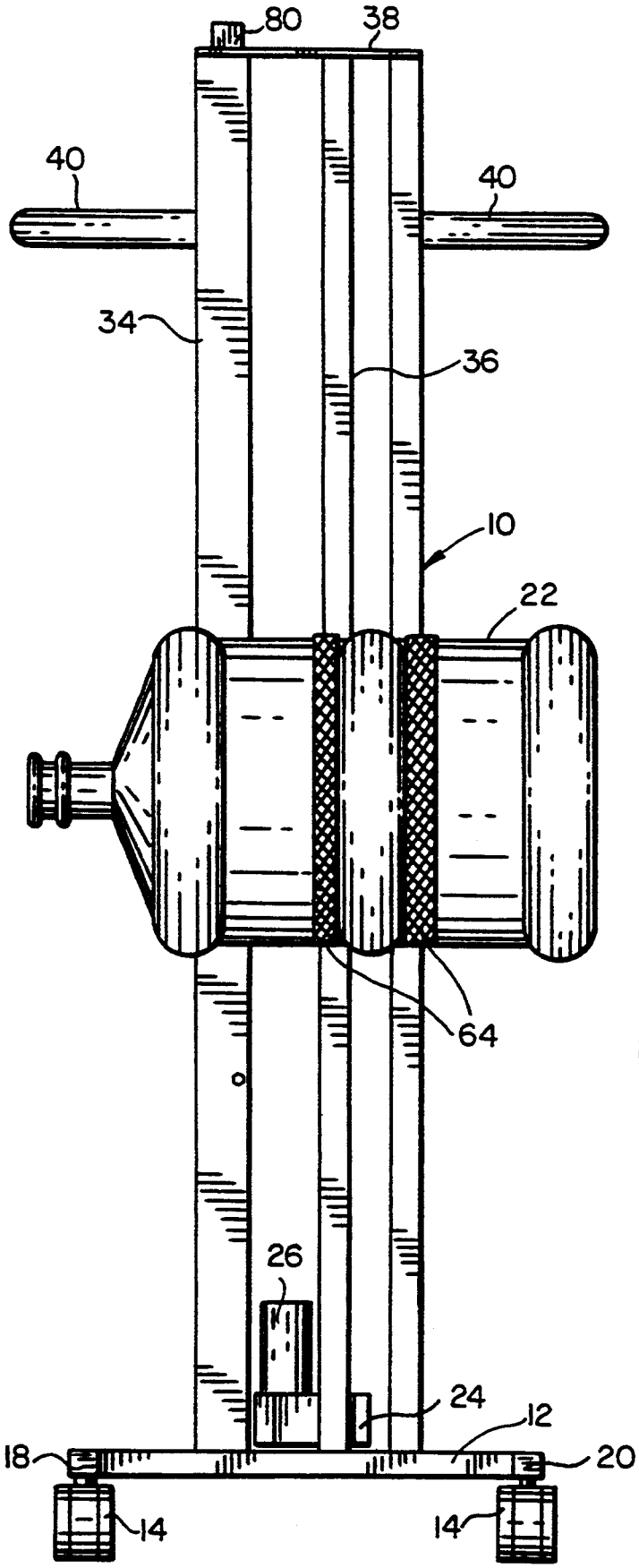
FIG. 13 is a front elevational view of the lifting mechanism showing the water bottle raised and turned 90°.
Figure 14:
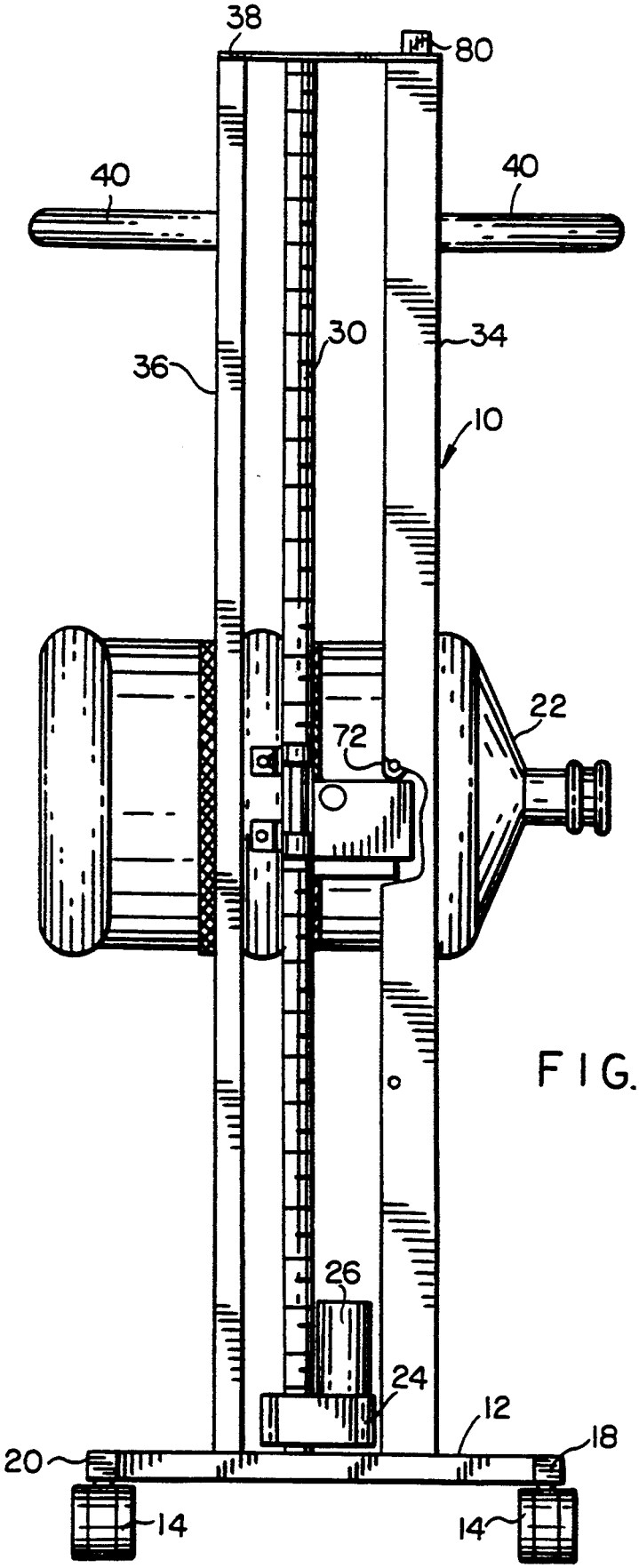
FIG. 14 is a rear elevational view of the lifting mechanism of FIG. 13.
Figure 15:
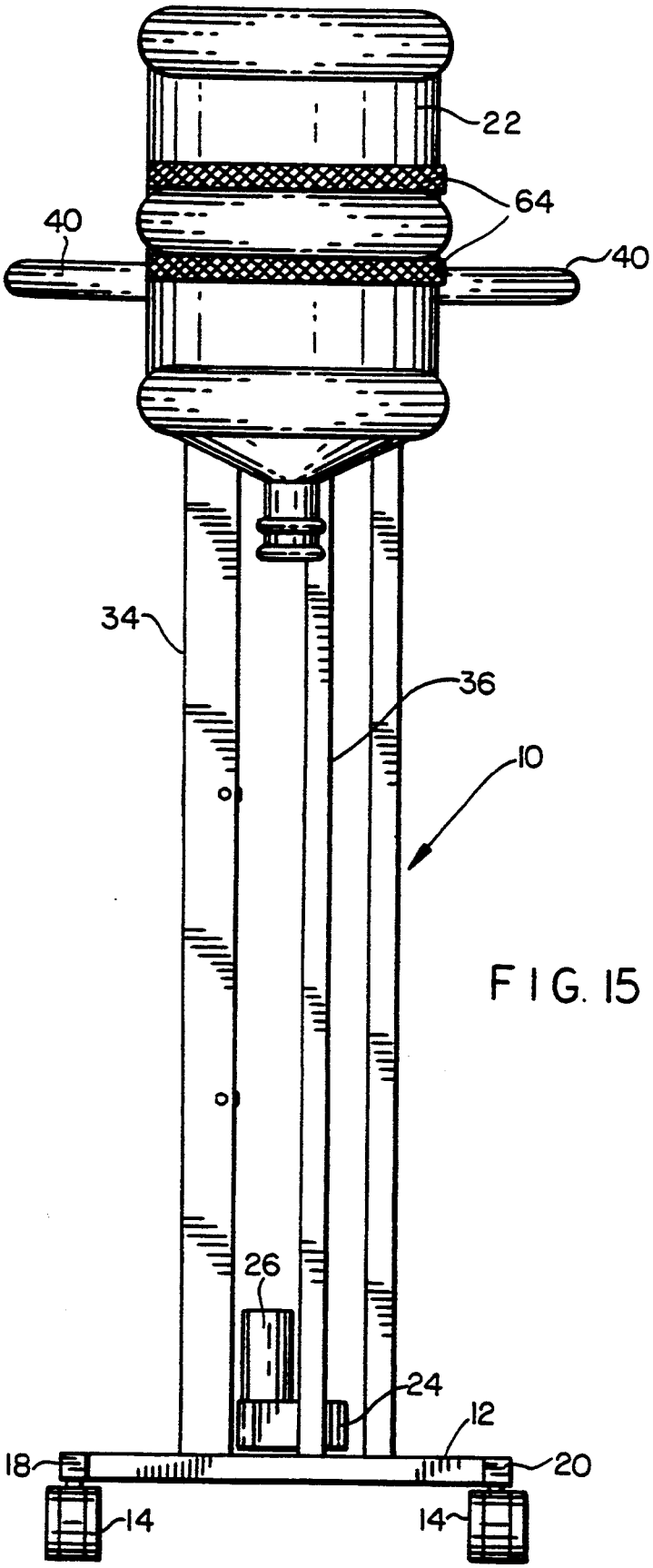
FIG. 15 is a front elevational view of the lifting mechanism showing the raised bottle fully inverted 180°.
Figure 16:
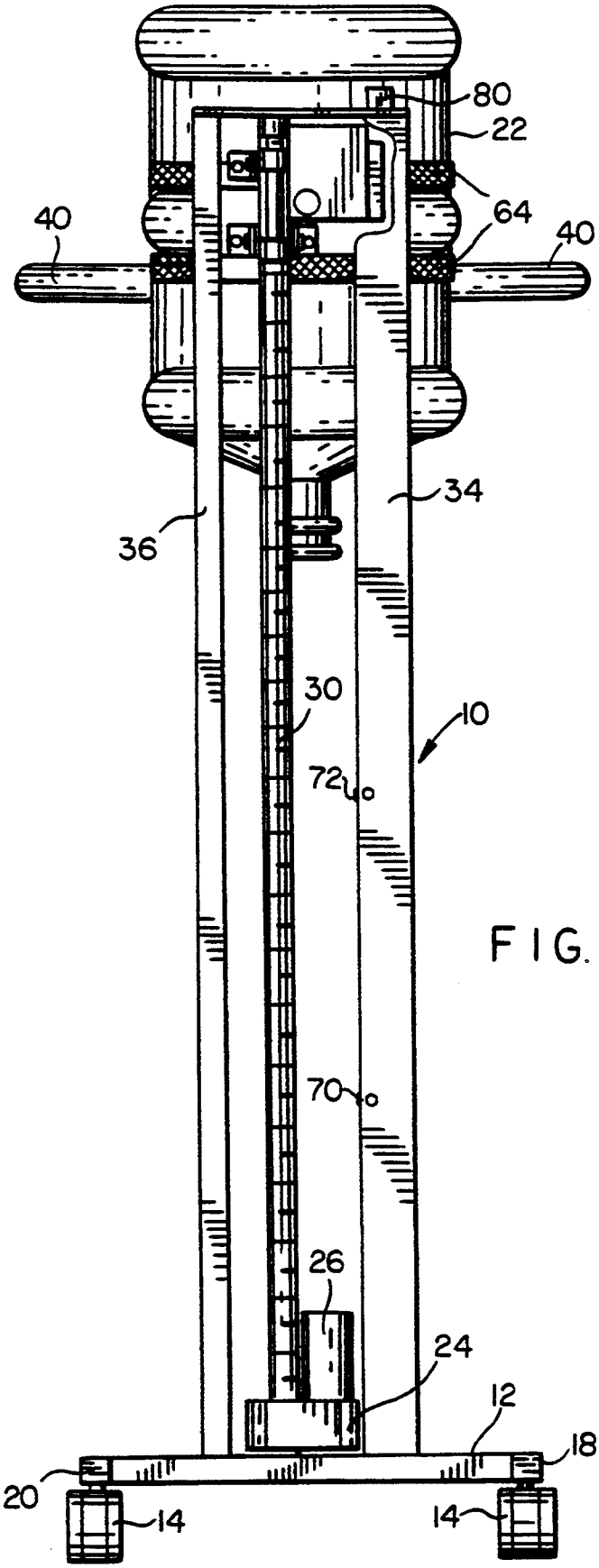
FIG. 16 is a rear elevational view of the lifting mechanism of FIG. 15.
Figure 17:
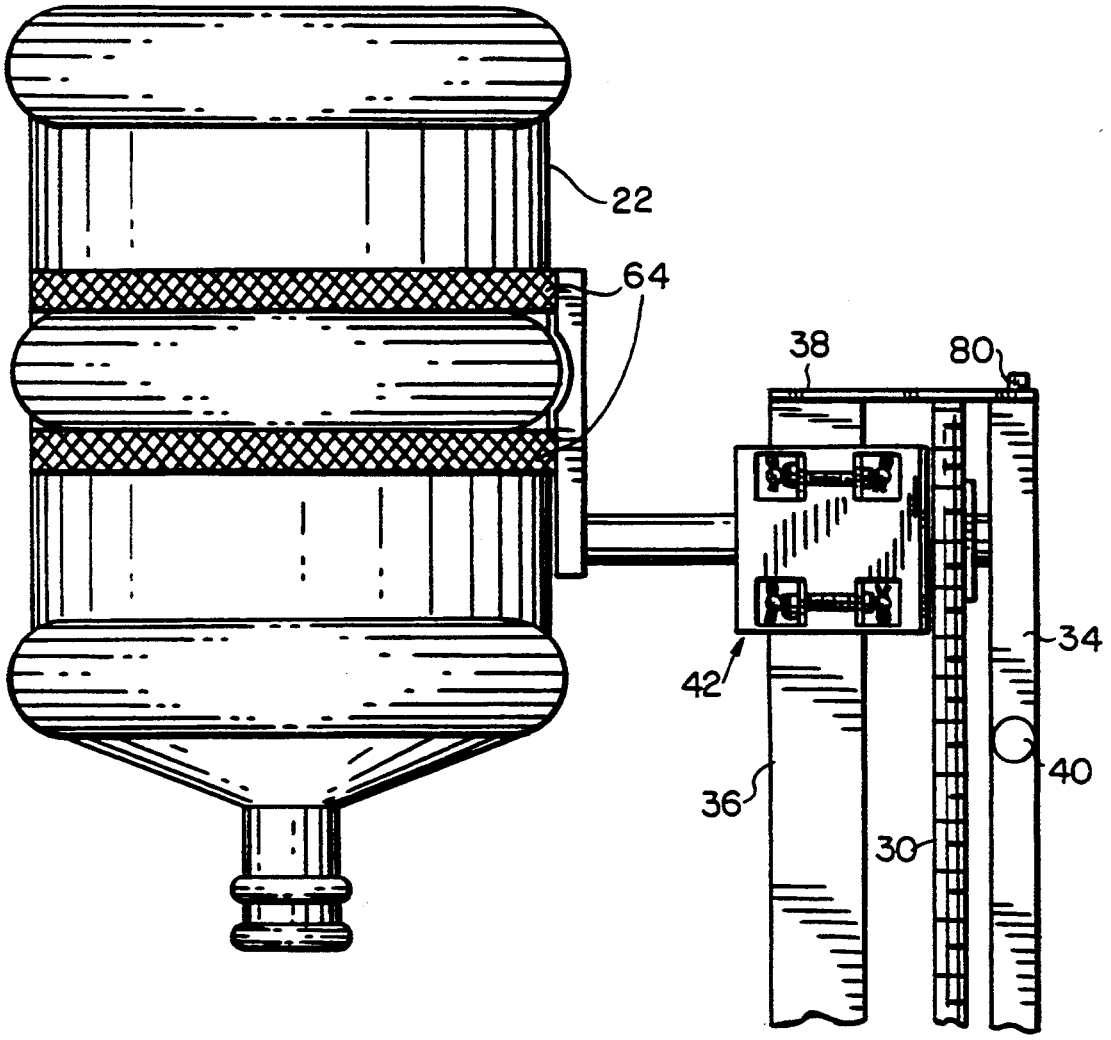
FIG. 17 is an enlarged side elevational view of the upper part of the lifting mechanism of FIGS. 15–16.
Figure 18:
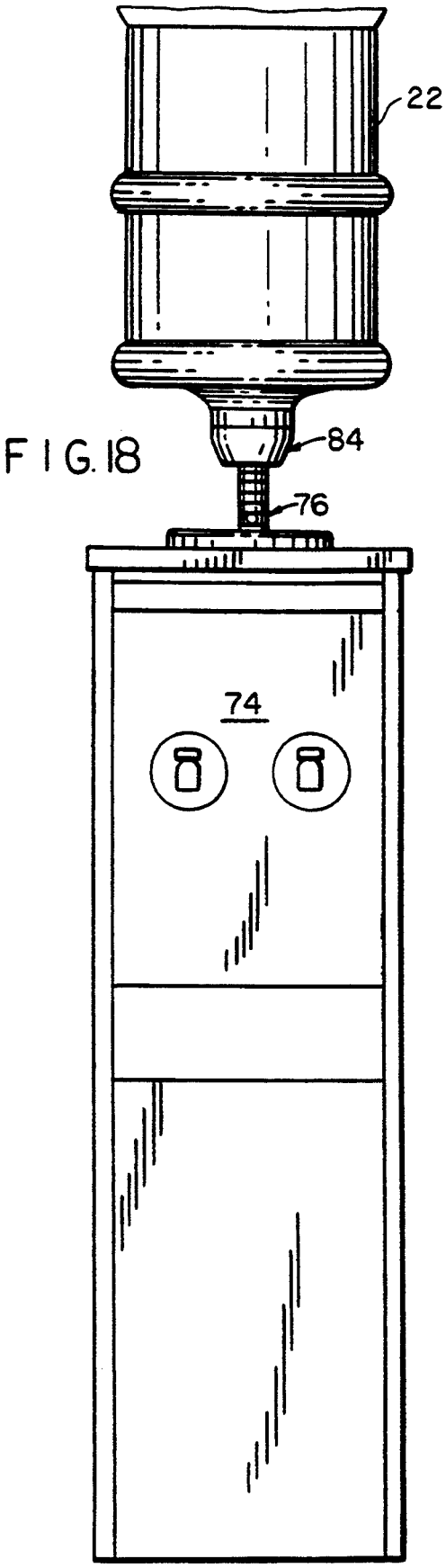
FIG. 18 is a front elevational view showing the inverted bottle having the closure of this invention on and closing the bottle neck opening, about to be lowered into the well of a water cooler.
Figure 19:
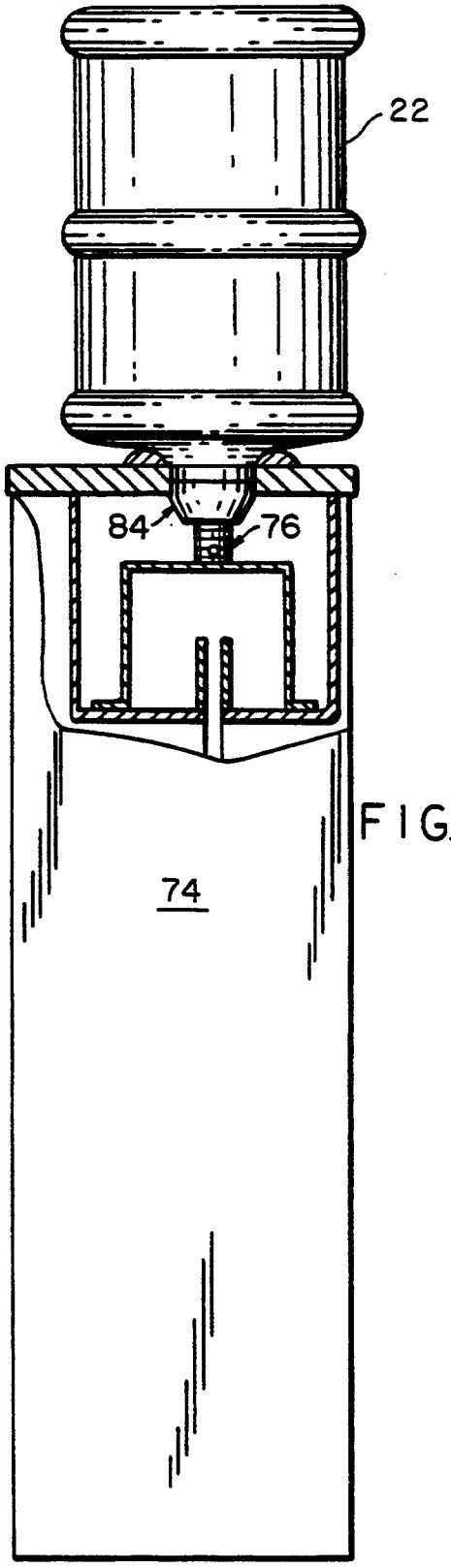
FIG. 19 is a front elevational view of the water cooler having portions thereof broken away and removed showing the inverted water bottle lowered into the well of the water cooler.
Figure 20:
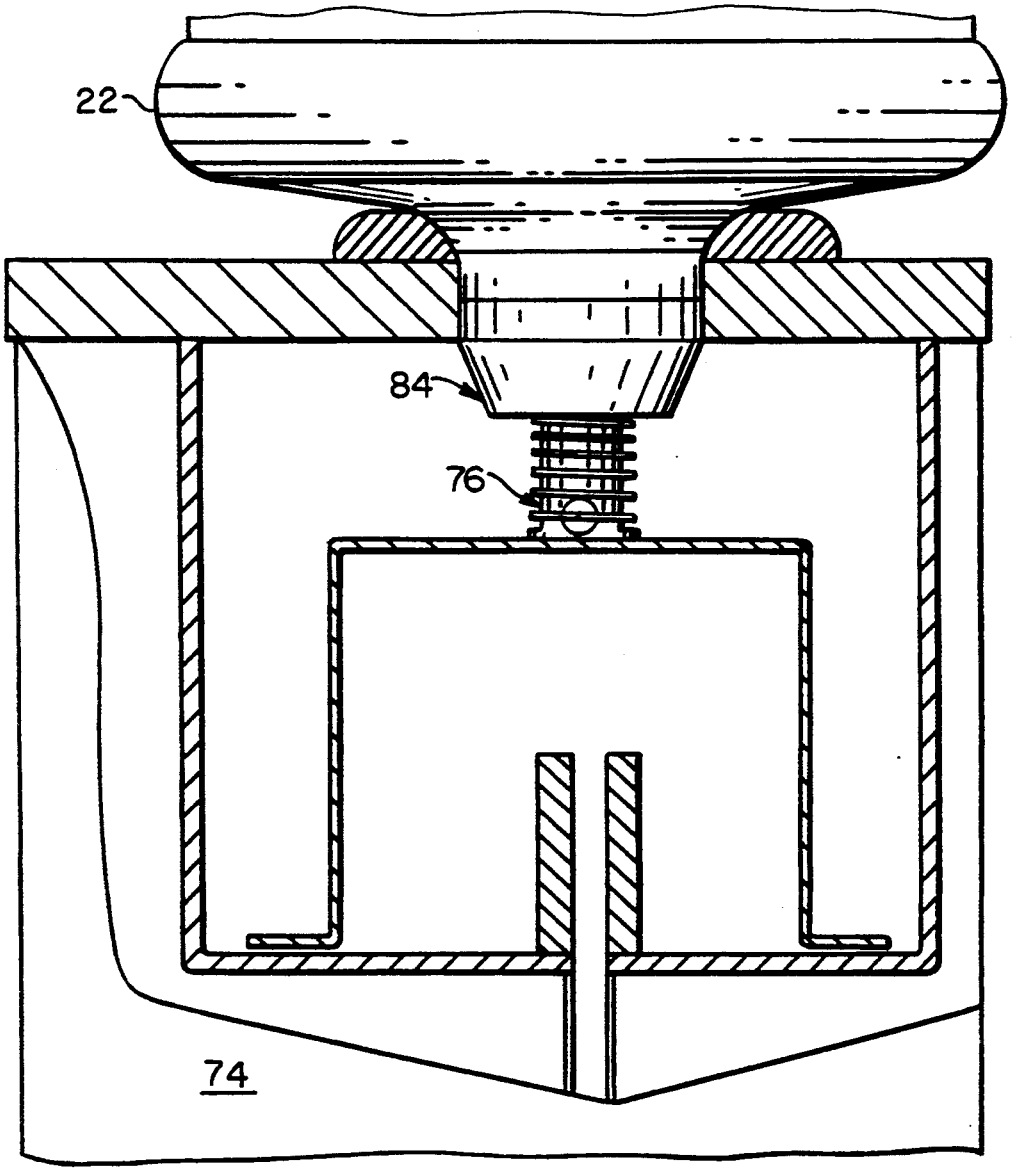
FIG. 20 is an enlarged fragmentary sectional view of the well of the water cooler showing the closure of the invention opened to allow the dispensing of water from the bottle.
Figure 21:
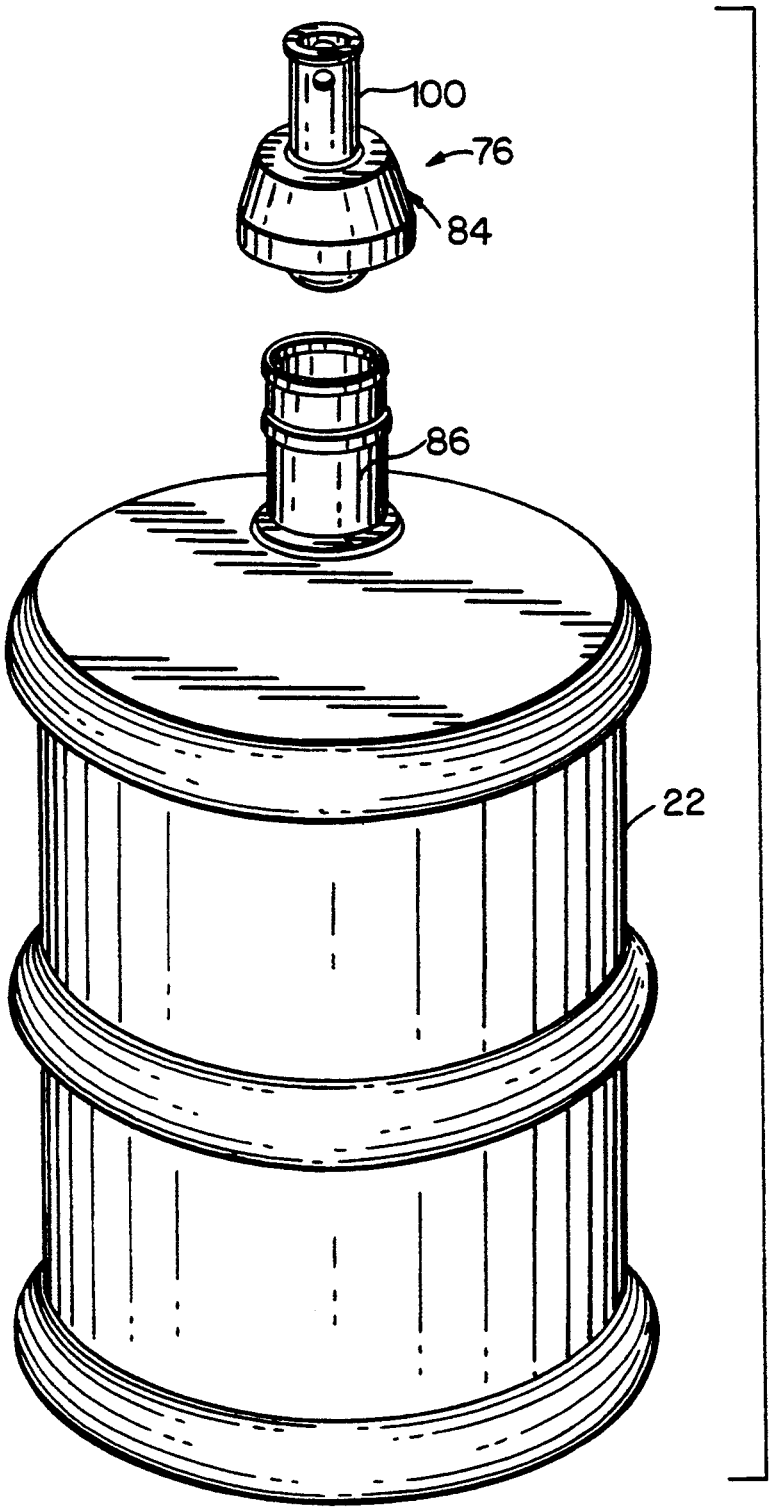
FIG. 21 is an enlarged exploded perspective view of a water bottle and closure of this invention.
Figure 22:
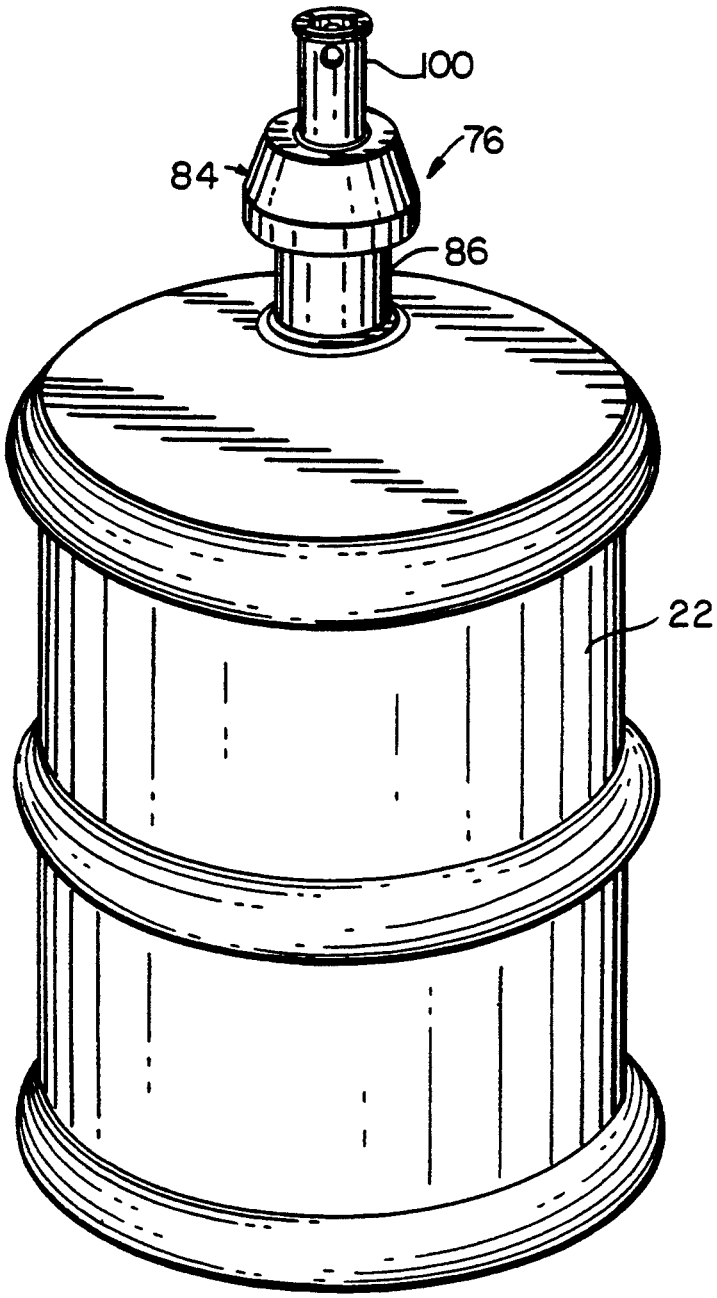
FIG. 22 is a similar perspective view with the closure coupled across the mouth of the neck of the bottle.
Figure 23:
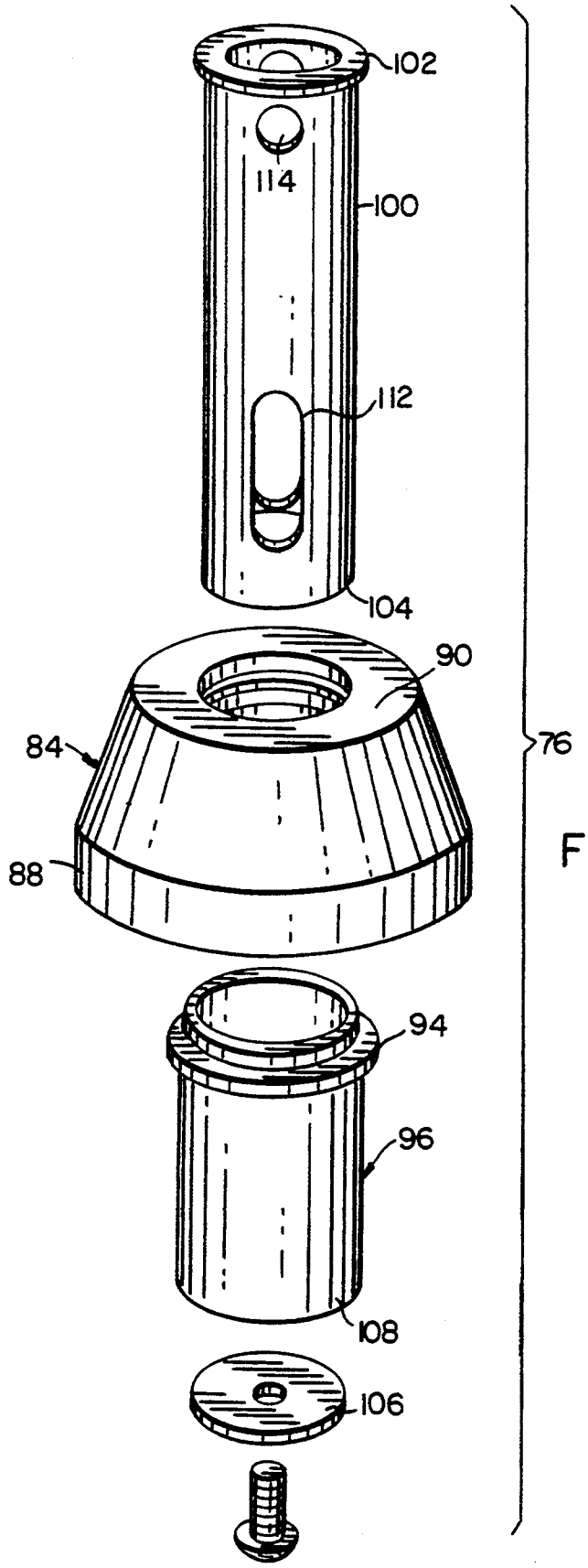
FIG. 23 is an enlarged, exploded perspective view of the closure of the invention.
Figure 24:
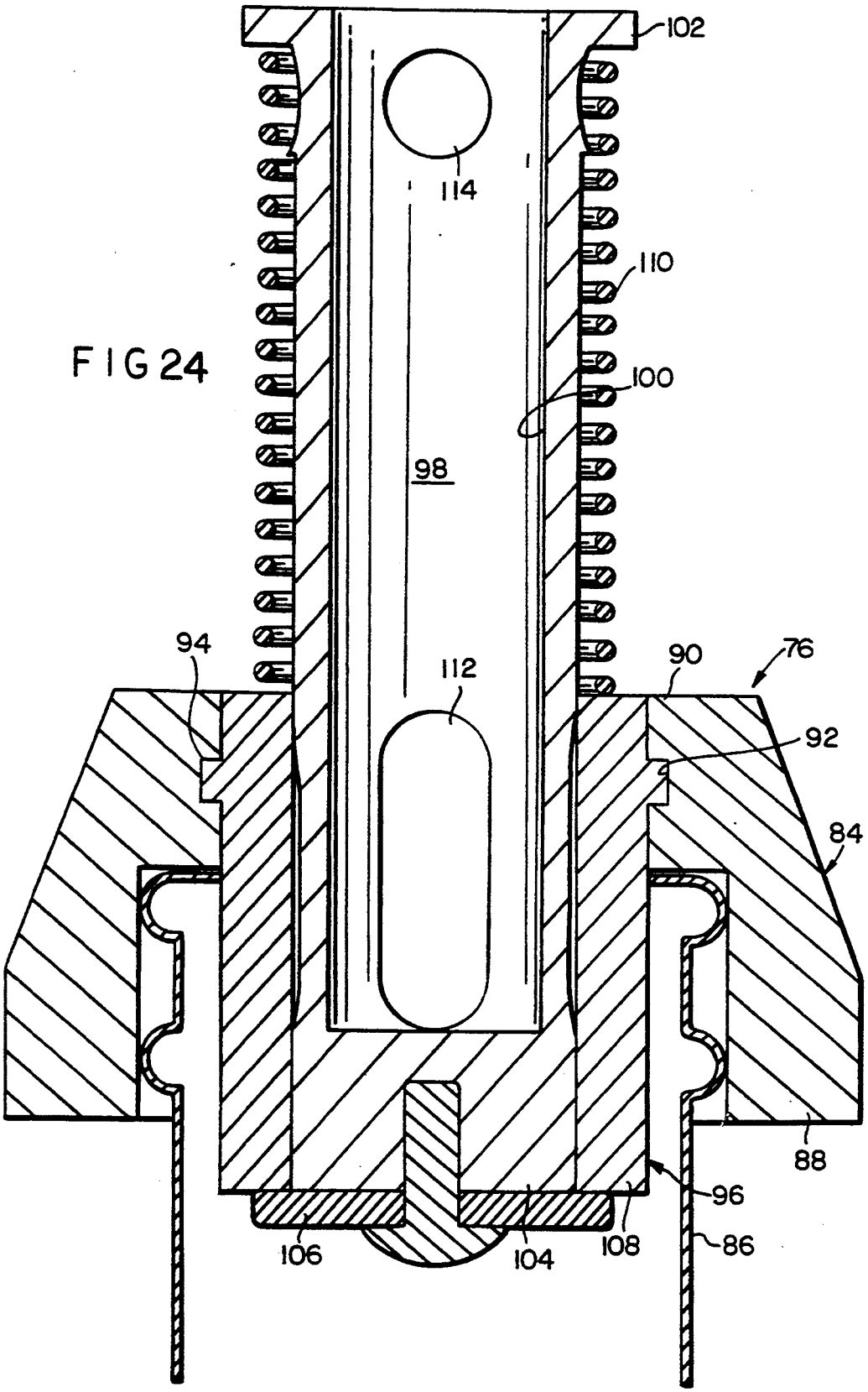
FIG. 24 is an enlarged longitudinal sectional view of the assembled closure shown associated with the neck of a water bottle with the closure in its closed sealed position.
Figure 25:
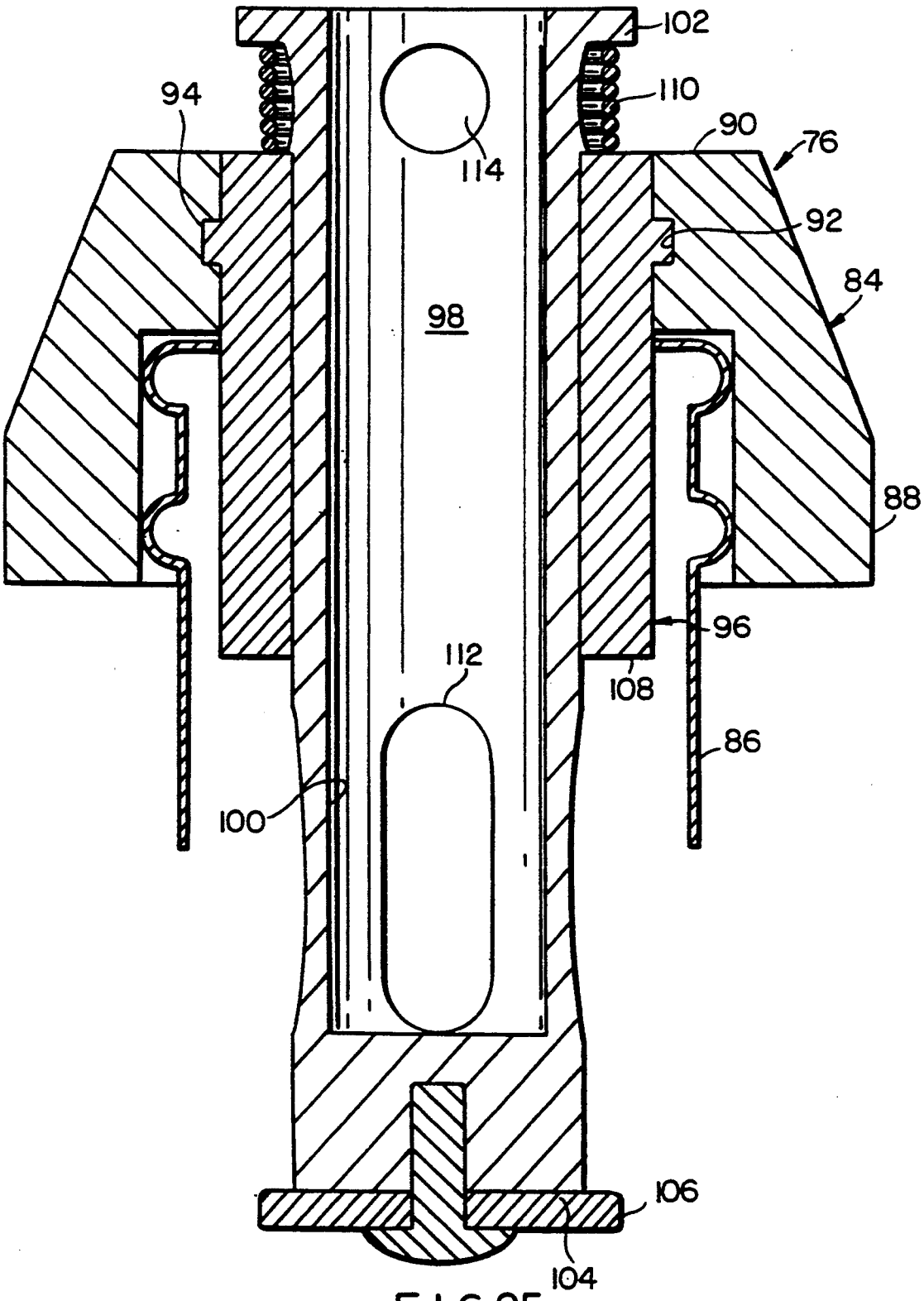
FIG. 25 is a similar longitudinal sectional view of the closure in its opened position for dispensing.

In the drawings, a lift mechanism 10 includes a base 12 which may be of welded tubular steel frame construction or of aluminum or suitable plastic construction or a combination of each. Swivel castors or wheels 14 may be at each of the corners of the base 12 to advantageously render the lift mechanism 10 readily movable or portable in any direction from one location to another. The base 12 is formed with an opening 16 so that arms 18 and 20 can straddle an upright water bottle 22 resting on the floor. The base 12 has mounted thereon a bracket 24 supporting motor 26 with attached reduction gear box 28 and journalling the lower end of the threaded rod a screw 30.

The base 12 also supports vertical elevator frame which includes vertical rail 34 and vertical elevator rail 36. The elevator frame includes a top plate 38 to which the top of rails 34 and 36 are connected and threaded rod 30 is suitably journalled.

A pair of handles 40 extend from the elevator frame 32 for facilitating movement of the lift mechanism 10 on the wheels 14.

The bottle elevator assembly 42 cooperates with the threaded rod 30 and elevator rail 36 in elevating the bottle 44 and includes elevator frame 46 that embraces rail 36. Nylon roller bushings 48 are rotatably mounted on clevis pins 50 and engage with the rail 12 in facilitating the vertical and lowering of the bottle 44. The clevis pins also serve to couple angle iron tensioners 52 to the frame 46. Tensioning bolts 54 extend through and bear against the pair of angle iron tensioners 52 on opposed sides of rail 36 and serve to pull the associated pair of angle iron tensioners together and consequently the roller bushings 48 tightly against rail 36. The frame 46 also has connected thereto nut 56 which meshes with the threads of rod 30 in raising and lowering the elevator assembly 42. A support sleeve 58 is fixed to frame 46 for receiving the rotatable support shaft 60.

The support shaft 60 has one end fixed to a plate 62 from which extends a pair of fastening straps 64 utilizing any conventional fasteners, such as Velcro, for releasably embracing and supporting the bottle 22. The other end of the rod 60 has mounted thereon 90° rotating cams 66 and 68 which are adapted to cam or bear against rotatable bearings 70 and 72 serving as cam followers in causing the rod 60 and consequently the bottle 22 to rotate in 90° increments in turning from an upright position to an inverted position.

The operation of the lift mechanism 10 will now be described. Initially, the lift mechanism will be moved to a location at which it may be associated with a full bottle 22 of water which is to be mounted on the cooler 74. For convenience of operation, it will also be assumed that the valve closure 76 to be described in detail shortly, is on the neck of the bottle 22. The arms 18 and 20 will straddle the bottle 22 which will be disposed in opening 16. The elevator assembly 42 will be in its lowered position so that straps 64 may be fastened about the body of the bottle 22. The lift mechanism 10 and supported bottle 22 may, if desired, be moved as close to the cooler 74 as possible. In any event, the motor 26 is activated by closing switch 80 to rotate threaded shaft 30 through the reduction gear box 28. The rotation of the shaft 30 will raise the nut 56 and consequently raise the elevator assembly 42 on elevator rail 36. The cam 66 will engage bearing 70 and as the elevator assembly 42 is raised, the rolling engagement between cam 66 and bearing 70 will turn the bottle 22 through 90°. As the elevator assembly 42 continues to rise to lift the bottle 22, the cam 68 will engage bearing 72 to turn the bottle another 90° and completely to its fully inverted position. The switch 80 may then be tripped manually or automatically to stop the raising of the elevator assembly 42. The lift mechanism 10 may now be moved to position and align the neck of the bottle 22 with respect to the well of the cooler 74. The elevator assembly 42, and, consequently the inverted bottle 22 may now be lowered by activating the switch 80 or another switch if desired which reverses the rotation of the motor 26 and shaft 30. When the neck of the bottle 22 is in the cooler well to a sufficient extent, the switch 80 is opened either manually or automatically to stop the motor and turning of the shaft 30. The straps 64 may be released to free the bottle 22 on the cooler 74. Thereafter, the lift mechanism 10 may be moved away. It should be understood that switch 80 may be of the type that will permit activation and reversal of the motor 22 and both raising and lowering of the elevator assembly 42. In order to return the elevator assembly 42 and shaft 60 to their original starting position, the motor 26 and shaft 30 are engaged in a reverse direction to enable the arms 66 and 68 to engage the bearings 72 and then 70 to reverse the movement of the shaft 60 and return it and cams 66 and 68 to their original position.

Now turning to the closure 76, a cap 84 of rubber or other elastomer possessing good sealing properties is adapted to be tightly placed over the neck 86 of bottle 22. The cap 84 includes a downwardly depending cylindrical skirt 88 and an upper inwardly extending flange 90 that has a annular recess 92 that receives flange 94 of inner cylindrical sleeve 96. The sleeve 96 slidably receives plunger 98 that has an axial bore 100 and is open at its flanged top 102 and closed at its bottom 104. The bottom may be provided with a suitably attached collar 106 that provides a seal with the lower face 108 of inner sleeves 96 to cooperate to close off the liquid within the bottle 22 when the bottle 22 is turned upside down by lift mechanism 10 to its inverted position. When necessary, a spring 110 can bias the plunger 98 to its closed position at which collar 106 seals against sleeve face 108. The bore 100 communicates with lateral ports 112 which will be sealed when the plunger 98 is in its closed position and opened to permit liquid in bottle 22 to flow into bore 100 when the plunger 98 is forced into its opened position when the bottle 22 is inverted which will be explained in detail shortly. When necessary, the upper part of plunger 98 may have lateral ports 114 to facilitate the dispensing process when the closure 76 is disposed in the well of the cooler 74.

The closure is placed on the neck 86 of the bottle 22 when in an upright position at which it will be strapped to the lift mechanism 10. The plunger 98 at this time will be in its closed position which can be effected either manually or under the influence of spring 111. During the turning of the bottle 22 by the lift mechanism 10 from its upright position to its inverted position, the plunger 98 will remain in this closed position with the pressure of the water tending to force the plunger into the closed position. When the inverted bottle 22 is lowered by the lift mechanism 10 into the well of the cooler 74, the flanged end 102 will engage surfaces of the cooler 74, to force the plunger 98 into its open position at which liquid will flow through lateral ports 112 into bore 100 and out the open end 102 where possible as well as lateral ports 114.

Thus, the several aforementioned objects and embodiments are most effectively attained. Although a single somewhat preferred embodiment of the invention has been described and disclosed in detail herein, it should be understood that this invention is in no sense limited thereby and its scope is to be determined by that of the appended claims.

What is claimed is:

1. A lifting mechanism for lifting a bottle containing a liquid from a lower upright position to an elevated inverted position comprising:

a frame including a base;

a motor supported on the base;

a threaded screw rotatably journalled on the frame and driven by the motor;

a vertically extending elevator rail supported on the frame;

a bracket movable on the frame;

a nut on the bracket meshing with the threaded screw so that rotation of the screw will move the bracket in a vertical direction;

a sleeve supported on the bracket;

a rotatable rod rotatably supported within the sleeve;

bottle support means at one end of the rod for embracing and supporting the bottle;

cam means for cooperating in turning the bottle at the other end of the rod; and bearings supported on the frame for engaging the cam means as the bracket is moved vertically to cause the rod to rotate and consequently cause the bottle to turn from its lower upright position to its elevated inverted position.

2. The invention in accordance with claim 1 wherein the bottle support means includes at least one strap for embracing and supporting the bottle and means for releasably connecting the strap about the bottle.

3. The invention in accordance with claim 1 wherein the base includes means for straddling a bottle to permit the bottle support means to embrace and support the bottle.

4. The invention in accordance with claim 1 wherein wheels support the base to permit the lift mechanism to be moved to a position to receive a bottle to a position at which an inverted bottle can be placed on a water cooler.

5. The invention in accordance with claim 1 wherein a reduction gear means interconnects the motor with the threaded screw.

6. The invention in accordance with claim 1 wherein the bracket supports rotatable bushings in engagement with the elevator rail and means for adjusting the pressure of the bushings on the rail.

7. The invention in accordance with claim 1 wherein the cam means includes two 90° cams on the rod causing the bottle to turn at 90° intervals from the lower upright position to the elevated inverted position.

8. The invention in accordance with claim 1 wherein switch means is on the frame for causing the bottle to move from the elevated inverted position to a lowered position at which the bottle may be placed in the well of a water cooler.

9. The invention in accordance with claim 1 wherein return means are provided for returning the lift mechanism back to its starting position at which the bottle support means may embrace and support another bottle.

10. The invention in accordance with claim 1 wherein the bottle support means includes at least one strap for embracing and supporting the bottle and means for releasably connecting the strap about the bottle, the base includes means for straddling a bottle to permit the bottle support means to embrace and support the bottle, wheels support the base to permit the lift mechanism to be moved to a position to receive a bottle to a position at which an inverted bottle can be placed on a water cooler, a reduction gear means interconnects the motor with the threaded screw, the bracket supports rotatable bushings in engagement with the elevator rail and means for adjusting the pressure of the bushings on the rail, the cam means includes two 90° cams on the rod causing the bottle to turn at 90° intervals from the lower upright position to the elevated inverted position, switch means is on the frame for causing the bottle to move from the elevated inverted position to a lowered position at which the bottle may be placed in the wall of a water cooler, and return means are provided for returning the lift mechanism back to its starting position at which the bottle support means may embrace and support another bottle.

11. The invention in accordance with claim 1 wherein the bottle is in the bottle support means and the bottle has a neck with an open mouth and a closure is on the neck of the bottle and is adapted to assume a closed position at which it closes the mouth when the bottle is in its lower upright position and during turning of the bottle from its lower upright position to its elevated inverted position, the closure is adapted to assume an open position at which it permits liquid in the bottle to be dispensed.

12. The invention in accordance with claim 11 wherein the closure comprises a cap to be coupled with the neck of a bottle, an inner sleeve connected with the cap and adapted to be disposed within the neck of the bottle, the inner sleeve having a lower face, a slidable plunger within the inner sleeve and adapted to be moved from an outwardly extending closed position to an inwardly extending open position, the plunger having an axial bore and an inner closed end and an outer open end, at least one lateral port at the closed end communicating with the bore, the lateral port being sealed off when the plunger is in its outwardly extending closed position and adapted to permit liquid flow through it into the bore when the plunger is in its inwardly extending open position.

13. The invention in accordance with claim 12 wherein the cap is of an elastomeric material and is adapted to sealingly engage the neck of the bottle.

14. The invention in accordance with claim 13 wherein the cap includes a downwardly depending skirt adapted to embrace the exterior of the bottle neck and an inwardly extending flange coupled with surfaces of the inner sleeve.

15. The invention in accordance with claim 14 wherein the inner sleeve is cylindrical and includes a pair of spaced flanges embracing the flange of the cap.

16. The invention in accordance with claim 12 wherein the plunger includes at least one lateral port at the outer open end communicating with the axial bore.

17. The invention in accordance with claim 12 wherein a collar is on the inner closed end of the plunger and is adapted to sealingly engage the lower face of the inner sleeve when the plunger is in its outwardly extending closed position.

18. The invention in accordance with claim 12 wherein the cap is of an elastomeric material and is adapted to sealingly engage the neck of the bottle, the cap includes a downwardly depending skirt adapted to embrace the exterior of the bottle neck and an inwardly extending flange coupled with surfaces of the inner sleeve, the inner sleeve is cylindrical and includes a pair of spaced flanges embracing the flange of the cap, the plunger includes at least one lateral port at the outer open end communicating with the axial bore, and a collar is on the inner closed end of the plunger and is adapted to sealingly engage the lower face of the inner sleeve when the plunger is in its outwardly extending closed position.

* * * * *